United States Patent [19]

Negosta

[11] 4,437,607

[45] Mar. 20, 1984

[54] MAIL BOX SIGNAL

[76] Inventor: Edward Negosta, 4803 Old Branch Ave., Camp Springs, Md. 20031

[21] Appl. No.: 223,287

[22] Filed: Jan. 8, 1981

[51] Int. Cl.[3] ..... B65D 91/00

[52] U.S. Cl. ..... 232/35; 232/34; 40/586; 116/215

[58] Field of Search ..... 232/34, 35, 36, 37; 40/486, 487, 488, 586; 116/215, DIG. 41, 315

[56] References Cited

U.S. PATENT DOCUMENTS

| | | | |
|---|---|---|---|
| 605,837 | 6/1898 | Avery | 116/215 |
| 879,022 | 2/1908 | Wolf . | |
| 2,754,051 | 7/1956 | Shellabarger . | |
| 3,017,073 | 4/1960 | Piergiovanni . | |
| 3,026,025 | 3/1962 | Hanson . | |
| 3,194,491 | 7/1965 | Parker . | |
| 3,318,516 | 5/1967 | Scheerer . | |
| 3,343,784 | 9/1967 | Waldhaus et al. . | |
| 3,498,255 | 3/1970 | Haeberle . | |
| 3,606,141 | 9/1971 | Taylor | 232/35 |
| 3,675,845 | 7/1972 | Scheerer . | |

*Primary Examiner*—Gene Mancene
*Assistant Examiner*—John Weiss
*Attorney, Agent, or Firm*—Zalkind & Shuster

[57] ABSTRACT

A signal for a conventionally constructed mail box is provided having a distinctive visual effect wherein co-action between a stationary and movable member shows a totally black field indicating no mail received, but shows a series of distinct white bars when a mechanism is automatically operated upon opening the door of the mail box to insert mail. The construction is substantially enclosed and very compact to be attached by a consumer on the back wall of a mail box with a signal control mechanism within the mail box extending from the back wall to the hinged door of the mail box. The invention is readily attachable to existing mail boxes with simple tools and sheet metal screws.

10 Claims, 15 Drawing Figures

MAIL BOX SIGNAL

STATUS OF THE PRIOR ART

In general, prior art patents show the basic combination of a movable element signal attached on the back wall of a mail box and motivated from an upper to a lower position by a control mechanism responsive to opening the door of the box. Such arrangements are shown in U.S. Pat. Nos. to Wolf 879,022; Shellabarger 2,754,051; Piergiovanni, 3,017,073; Hanson 3,026,025; Parker 3,194,491; Scheerer 3,318,516 and Scheerer 3,675,845.

The patented art generally show metallic flag signal members requiring a large movement to be clearly visible after motivation not only to the home owner looking towards the rear of the box but in most instances the actuated signal is visible to vandals or thieves passing on the road where the box is located. Thus, vandalism and theft has been known to occur. Further, the above patents have exposed signal elements which when subjected over a period of time to rain, sleet, snow and frost can become inoperable for their intended purpose.

SUMMARY OF THE INVENTION

The invention provides a substantially enclosed arrangement utilizing a flat casing with a pivotal signal member therein having only a small tab outwardly of the casing for the purpose of restoring the signal member non-signal condition after operation. A unique visual presentation requires but a limited movement of the signal member to signal position. Thus, the back wall of the casing is painted a flat black, or other color to contrast with a plurality of spaced areas painted in radial array thereon with the pivot point of the signal member as center. The signal member has cut out areas which register with the spaced painted areas in signal position whereby the series of painted areas show through and are clearly visible only at the back of the box as a series of. e.g., white bars or stripes, or other design, preferaby in fan array, indicating mail received.

The signal member is a sector of a circle, almost quadrantal in shape but not a full quadrant, approximately 80°-85°, so that the pivotal movement can be quite limited. The signal control mechanism has a spring loaded rod which engages the signal member to hold a non-signal position, wherein the spring pulls the rod to release position when permitted to expand under control of a door held rod, a second spring compressed by the latter rod when the door is closed to compress the holding spring being utilized.

Thus, a first signal member is fixed, being the back wall of a casing and a second signal member is pivotal, whereby relative movement effects a coaction presents a visual signal.

A signal control means utilizing tandem springs to effect holding or release of the signal member responsive to an open or door closed condition of a mail box compensates for differing lengths of mail boxes which might be expected to be met.

The invention is primarily intended to be a complete unit salable as a kit to be installed on existing mail boxes. However, the essential components could be incorporated as part of a mail box utilizing the end of the mail box as a wall for the array of painted areas.

A detailed description of the invention now follows in conjunction with the appended drawing, in which:

FIG. 1 is a side view of a conventional mail box showing the signal casing at the rear wall and the signal control mechanism within the box extending from the front door to the rear wall.

FIG. 1-A is a plan view showing the signal casing at the back wall and the general orientation of the control mechanism within the box.

Figure 3:
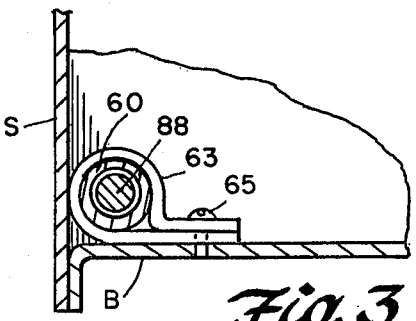
FIG. 3 is a fragmentary detail illustrating a mode of securing the front end of the control mechanism to the floor of the box.

Referring now to the drawing, FIGS. 1–4, a mail box M is disclosed having a front door D, bottom B having flanges F and a back wall W wherein a signal casing 10 of the invention is attached to the back wall W and a signal control mechanism 15 extends from front to back of the mail box. The casing 10 (FIG. 2) consists of a single sheet, preferably aluminum, formed into an approximately square flat box having a back wall 18, side flanges 21 formed at right angles to the back wall and thereafter formed into front flanges 24, the four front flanges being all in the same plane and spaced from the casing wall 18 which is a first signal member.

Figure 4:
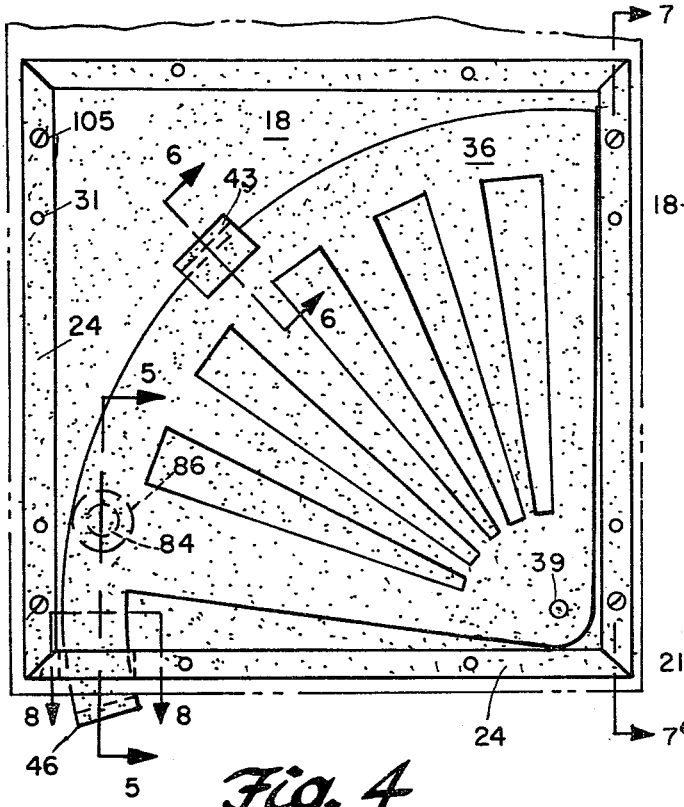
FIG. 4 is a full face view of the invention as seen at the rear of the mail box as it would be viewed from a house window, showing by the dotted area a completely black expanse to indicate a non-signal or no mail condition.
Figure 7:
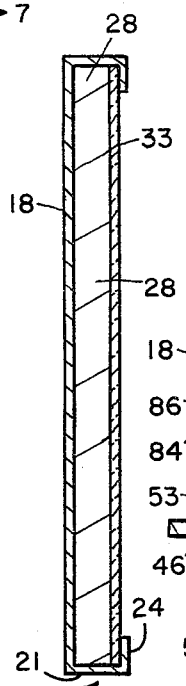
FIG. 7 is a section through 7—7 of FIG. 4.
Figure 6:
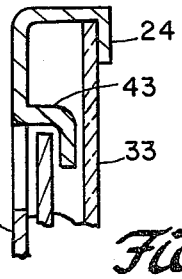
FIG. 6 is a section through 6—6 of FIG. 4.
Figure 4B:
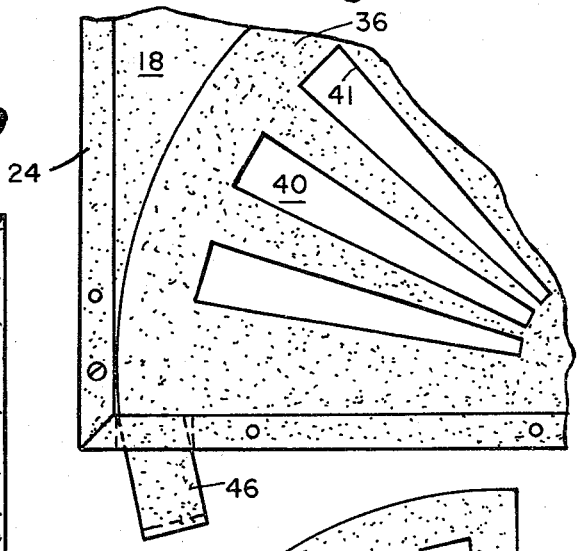
FIG. 4B shows a portion of FIG. 4 wherein, however, the signal member has now pivotally dropped to show the white bars of the back wall of the casing through registering slots of the signal member, indicating that mail has been delivered.
Figure 4A:
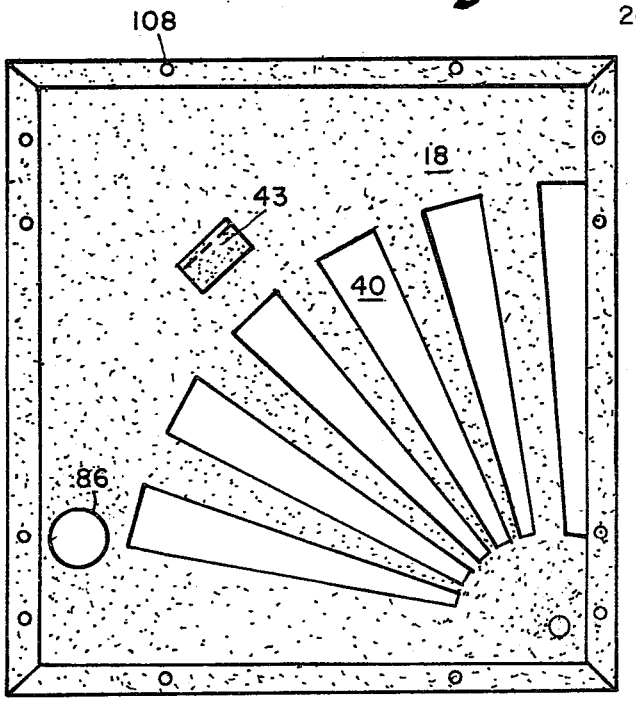
FIG. 4A illustrates the back wall of the signal casing as seen with the front elements of the invention removed and showing painted white bars on a black field in radiating or fan pattern.
Figure 4C:
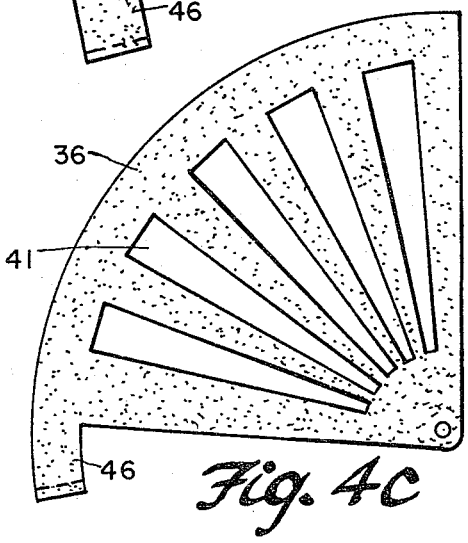
FIG. 4C is a plan view of the signal member, to a reduced size.

Thus, a single sheet of suitable metal may be corner cut and formed with mitered corners as shown in FIGS. 4, 4A and 4B to form the casing which effects a rigid frame.

The frame formed by the side and front flanges of the casing effects channels in which may be inserted insulating and sealing wood strips 28 spacedly fit within respective channels and mitered at the corners, as will be understood. Such wood strips are spacers for a transparent plastic front window 33 holding it snugly within the confines of the front flanges 24 wherein the major area of the transparent plate is exposed through the open front of the casing. The entire assembly can be held together as by rivets 31, it being understood that the wood side members, a pivotal signal member 36, and the front clear plastic window 33 are installed before the framing flanges 24 are bent over to complete the enclosure. Thus, signal member 36 is a second signal member which coacts with back wall 18 in a manner to be described, having respective areas for concealing and revealing a signal.

Thus, a substantially enclosed housing is effected in which is pivotally carried the quadrantal signal member 36 of flat metal, likewise preferably aluminum, and which is pivoted for loose and free movement as by a rivet 39 to the rear wall 18 of the casing. It will be noted that signal member 36 is somewhat less than a right angle so that in the position shown in FIG. 4, the generally vertical edge can abut within the casing against a side wood strip to be held there in such position as seen in FIG. 4, whereat only a black expanse is viewed.

However, of its own weight the signal member 36 can drop so that its lower edge, as seen in FIG. 4B, can abut the bottom wood strip of the casing. At this time, the series of white areas or bars 40, frustum shaped, painted stripe-like on the back wall 18 appear through respective registering slots 41 of signal member 36, being clearly visible and giving a distinct signal presentation of spaced stripes.

The signal member 36 is preferably guided by a bent out flange 43 struck from the back wall 18 wherein the circular edge of the signal member rides loosely within the confines of the guiding flange. The outer corner of the signal member is extended to form a tab 46; after dropping to indicate mail in the box, it can subsequently be reset by pushing the tab up, from the position shown in FIG. 4B to the position shown in FIG. 4, the mail having been removed and the door reclosed.

It will, of course, be understood that the precise number of painted white bars on the casing wall 18 in coaction with a lesser number of slots in the signal member 36 is not critical.

They can be equal in number but I have shown six such bars and five slots. However, any desired array commensurate with giving a clear signal could be used and any contrasting colors used. I have found that stark contrast of black and white on wall 18 and a black painted signal member is highly visible effecting a fanned array of white stripes against a full black field.

A small signal member 36 with limited motion makes confinement of the signal member entirely within the protection of the casing economical and the overall signal less prone to weather damage. The arrangement of five slots and six white coacting stripes gives a clear signal, wherein the side margins of the movable signal member effects concealing without the need for a sixth slot. This reduces size and movement of that member, wherein the bottom and side framing of the casing interiorily serve as stop members for the signal member motion in concealing or revealing positions.

The tab 46 extending downwardly and then bent back to be underneath the mail box effects weather protection.

Figure 5:
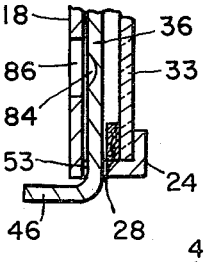
FIG. 5 is a section through 5—5 of FIG. 4.
Figure 8:
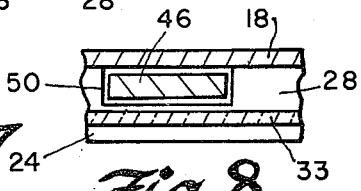
FIG. 8 is a section through 8—8 of FIG. 4.

From the foregoing it will be apparent that a very compact and rugged construction is afforded by the invention which can be totally sealed and protected from weather conditions, although it will be noted that a slot 50 in the bottom wood member 28 is provided for the tab, as well as a slot 53 in the bottom flange of the metal casing, all as will be evident from FIGS. 5 and 8. Of course, suitable tolerances to allow easy gravitational dropping of the signal member 36 is provided between adjacent members of the combination to avoid frictional effects.

While I have shown and experimented with sheet aluminum signal members having slots, it will be obvious that a clear or translucent member of plastic or glass could be used, rendered opaque except for bars of transparency or translucency. Further, instead of four wood framing strips, an integral inner frame of molded plastic or rubber could be used. Also, the casing could be a molded or cast in the configuration of an open front shallow box with a cover secured thereon of molded clear plastic having side flanges either inside or outside the casing sides. While I have found that the force of gravity is normally sufficient to effect swinging of the signal member, it is obvious that springs could be used. For example, a simple spring leaf disposed between the inner vertical wood frame piece and the adjacent edge of the signal member.

Figure 1A:
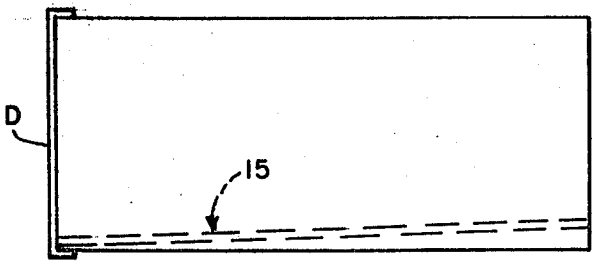
Figure 1:
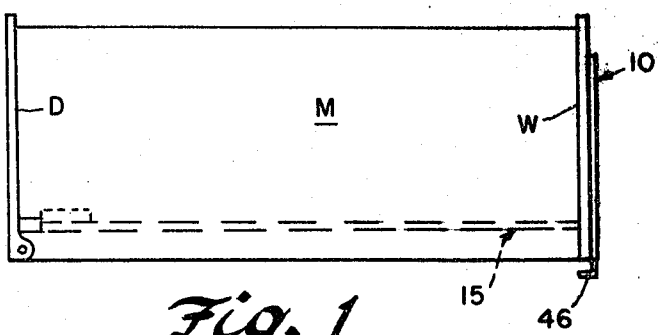
Figure 2:
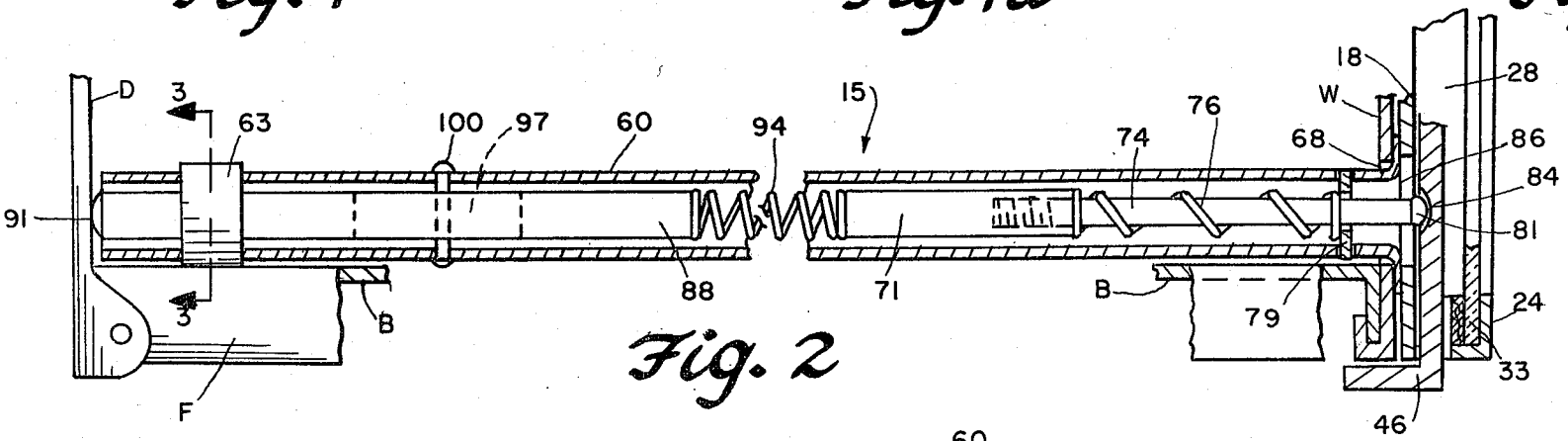
FIG. 2 is an elevation in section showing the essential components of the invention.
Figure 2C:
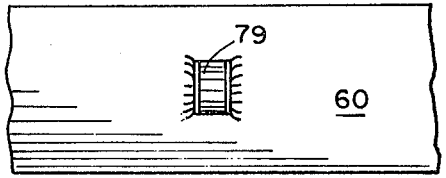
FIGS. 2A, 2B and 2C show details of a motion limiting slot and of a washer abutment in the control mechanism.
Figure 2B:
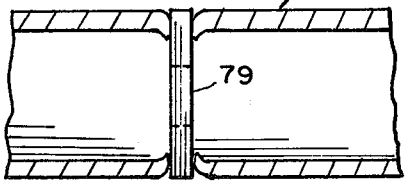

The signal control mechanism 15 comprises a carrier tube 60 extending substantially the length of the mail box as seen in FIGS. 1, 1A and 2, and secured at the forward and corner adjacent to hinged door D by a metal clamping strap 63 fastened as by a screw 65 (FIG. 3) to the bottom panel B of the box, generally adjacent the side wall S. The tube extends to the rear wall W of the box and passes through an aperture 68 therein being suitably flared on the inner side of the back wall W. Tube 60 carries slidably therein a short rod 71 to which is threadedly fastened a signal member holding plunger 74 encompassed by a compression spring 76 which extends between the end of rod 71 and a washer 79 firmly fastened transversely into tube 60. Thus, the tube has opposed slots into which opposed edges of the washer fit and the sides of the slots are bent in to securely hold the washer, as illustrated in FIG. 2C. The end of plunger 74 is provided with a button 81 which protrudes into a shallow detent recess 84 deformed into the back of the sheet metal signal member 36. The outer end of the plunger passes through an aperture 86 provided in the back wall 18 of the casing 10, slidably guided in washer 79.

It will be noted that the spring 76 abuts compressively between the fixed washer 79 and the outer end of slidable rod 71 and thus has the effect of biasing rod 71 to the left as viewed in FIG. 2 to pull the plunger 74 away from the signal member 36 out of the recess 84. Accordingly, for the view shown in FIG. 2, the plunger is in signal holding position. At that time only a black field is visible at the back of the mail box through window 33 as seen on FIG. 4. However, upon leftward movement of rod 71 by expansion of the spring 76, such holding condition is removed and the signal member can drop to exhibit white bars as viewed in FIG. 4B, i.e., the painted bars or stripes 40.

Figure 2A:
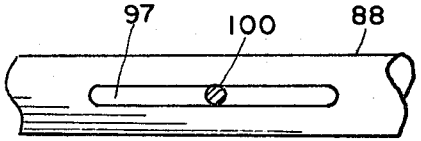

Operation of plunger 71 for a holding or releasing condition is effected by a further rod 88 slidable in tube 60 and having a button 91 engaged by the mail box door D in closed position as seen on FIG. 2. A second compression spring 94 is carried within tube 60 and abuts at respective ends with the ends of rods 71 and 88. Limited movement of rod 88 and retention is provided by a slot 97 therethrough and through which passes a pin 100 secured at its ends at opposite sides of tube 60, FIG. 2A.

In operation, when door D is closed, pressure on button 91 moves rod 88 to compress spring 94, thereby moving rod 71 to compress spring 76 while at the same time moving button 81 into detent recess 84 to the hold condition shown in FIG. 2. This assumes the signal member 36 has been pushed upwardly by thrust on tab 46 either before or after closing of door D. Thus, the signal member gives the black field (no mail) signal effect of FIG. 4. However, when door D is opened to place mail in the box, rod 88 is released and thrust outwardly to the dotted position shown in FIG. 2 by expansion of spring 94. This permits spring 76 to expand since an end abuts the fixed washer 79. Accordingly, spring 76 moves rod 71 in the direction to pull button 81 out of detent recess 84, releasing the signal member 36 to give the visible white bar signal shown in FIG. 4B. As a mechanical expedient spring 94 may be made stronger than spring 76, but at least strong enough to compress spring 76 when the door D is closed.

Attachment to an existing mail box is made by using a cardboard or paper template on which is marked holes for sheet metal screws 105 as shown in FIG. 4, and punching small pilot or starting holes with a nail in the sheet metal end wall of the mail box. Likewise, the template locates a starting hole for aperture 68, by use of a larger nail which hole can then be enlarged to the approximate outer diameter of tube 60 by a common flaring tool of the kind used for flaring copper tubing or by thrusting long-nose pliers through the starting hole and using such pliers like a flaring tool.

As a practical matter, I have found conventional copper tubing suitable, with the flared and flattened radially for compactness. Thus, before installation of the casing 10, the tube 60 is installed with the flattened radial flared end against the back wall 18 of the mail box, and the other end of the tube fastened with the strap 63. Thereafter, the casing 10 is secured in proper position with screws 105 passing through holes 108 provided through the framing and casing (FIG. 4*a*) so that the screws enter the respective punched pilot holes. The button 81 will then be aligned with aperture 86 for operation in detent recess 84.

It will now be apparent that the use of tandem springs 76, 94 makes it possible to accommodate the signal control means 15 to mail boxes which may vary in length within expected limits. Thus, were a solid rod between buttons 81 and 91 and single spring used it would fit only one fairly precise length of mail box. For example, if the box were a fraction of an inch shorter than the solid rod, the closing door force on the rod could damage both the door and the relative thin signal member 36 possibly bending it to inoperability.

I claim:

1. A mail box having a door, bottom, and an end having a signal means;

a control means operative on said signal means responsive to door position;

the improvement comprising:

a first signal member (18) having a plurality of spaced signal areas:

a second signal member (36) having alternate concealing and revealing areas movable to alternately register with said spaced signal areas of said first member in respective relative concealing or revealing positions of said first and second signal members to conceal or reveal said signal areas; said revealing areas of said second signal member being slots therethrough and said concealing areas comprising areas intermediate adjacent slots;

said signal members being of the same color except for color contrast of said spaced signal areas.

2. Signal means having relatively movable members for concealing or revealing a signal on a mail box of the kind having a door, a bottom, and an end area and including a control means operative on said signal means responsive to door position for effecting a signal;

the improvement wherein said signal means comprises:

a first signal member (18) having several signal areas separated so as to be spacedly visible;

a second signal member (36) having alternately disposed concealing and revealing areas whereby relative movement of said members to an extent predetermined by the dimensional relationship between said signal areas and said concealing and revealing areas effects concealing or revealing of said signal areas; wherein said spaced signal areas are stripe-like and displayed in a radial array; said second signal member being quadrantal and pivotally supported on a center from which said signal areas radiate.

3. A mail box having a door, bottom, and an end having a signal means;

a control means operative on said signal means responsive to door position;

the improvement comprising:

a first signal member (18) having a plurality of spaced signal areas:

a second signal member (36) having alternate concealing and revealing areas movable to alternately register with said spaced signal areas of said first member in respective relative concealing or revealing positions of said first and second signal members to conceal or reveal said signal areas; including the further improvement of control means comprising a first control member (88) adapted to engage the mail box door and a second control member through the mail box end;

a first spring (94) intermediate said control members;

a second spring (76) abutting said second control member at one end and means (79) providing a fixed abutment at the opposite end of said second spring;

whereby closing of the mail box door moves said first control member to compress both said springs operative for holding engagement of said second signal member in concealing position and wherein opening said door permits expansion of said springs to withdraw said second control member for releasing said hold engagement permitting movement of said second signal member to signal revealing position and to move said first control member in position to be engaged by said mail box door in closing for compressing said springs to holding position of said second control member.

4. A mail box having a door, bottom, and an end having a signal means;

a control means operative on said signal means responsive to door position;

the improvement comprising:

a first signal member (18) having a plurality of spaced signal areas:

a second signal member (36) having alternate concealing and revealing areas movable to alternately register with said spaced signal areas of said first member in respective relative concealing or revealing positions of said first and second signal members to conceal or reveal said signal areas;

means for pivotally mounting said second signal member to move between respective registering positions relative to said spaced signal areas to reveal or conceal said spaced signal areas;

control means comprising a first control member adapted to engage the door of the mail box and a second control member engageable with said second signal member;

a first spring intermediate said control members;

a second spring abutting said second control member at one end and means providing a fixed abutment at the opposite end of said second spring;

whereby closing of the mail box door moves said first control member to compress both said springs operative to hold said second signal member in concealing position by engagement of said second control member therewith and whereby opening said mail box door releases the compression of said springs to withdraw said second control member permitting said second signal member to pivot to concealing position.

5. In a signal apparatus for a mail box, signal means comprising a signal member (36) movable between a first position indicating mail in the mail box and a second position indicating no mail in the mail box;

control means (15) comprising a first control member (88) adapted to engage the door of the mail box and a second control member (71) directly with said signal member;

a first spring (94) intermediate said control members;

a second spring (76) abutting said second control member at one end and means (79) providing a fixed abutment at the opposite end of said second spring;

whereby closing of the mail box door moves said first control member to compress both said springs operative to hold said signal member in concealing position.

6. In a signal apparatus for a mail box as set forth in claim 5, including a casing for said signal member attachable at the end of a mail box and a tab for resetting said signal member;

said casing having a bottom edge with an opening whereby said tab extends exteriorly of said casing through said opening downwardly and thence rearwardly of said casing for access below a mail box to protect said tab against weather conditions, wherein said signal member is movable entirely within the confines of said casing.

7. In a signal apparatus for a mail box as set forth in claim 5, including a casing for said signal member having a wall with an aperture (86) therethrough;

said second control member passing through said aperture to engage said signal member;

said casing enclosing said signal member and having a transparent wall for viewing the position thereof.

8. In a signal apparatus for a mail box as set forth in claim 7, said control members being rod-like and a tube (60) for maintaining assembly thereof with said springs.

9. In a signal apparatus for a mail box as set forth in claim 8, including means (79) within said tube effecting said fixed abutment and being apertured to slidably guide said second control member.

10. In a signal apparatus for a mail box as set forth in claim 5, said signal means comprising an element (18) having spaced signal areas (40) and said signal member (36) having spaced signal revealing areas registrable with said signal areas in said first position and also having spaced signal concealing areas registrable with said signal areas in said second position.

* * * * *